US011096479B2

(12) United States Patent
Mansson et al.

(10) Patent No.: US 11,096,479 B2
(45) Date of Patent: Aug. 24, 2021

(54) FURNITURE SYSTEM

(71) Applicant: IKEA SUPPLY AG, Pratteln (CH)

(72) Inventors: Peter Mansson, Killeberg (SE); Benny Andersson, Almhult (SE)

(73) Assignee: IKEA Supply AG, Pratteln (CH)

( * ) Notice: Subject to any disclaimer, the term of this patent is extended or adjusted under 35 U.S.C. 154(b) by 12 days.

(21) Appl. No.: 16/611,566

(22) PCT Filed: Apr. 27, 2018

(86) PCT No.: PCT/SE2018/050435
§ 371 (c)(1),
(2) Date: Nov. 7, 2019

(87) PCT Pub. No.: WO2018/208206
PCT Pub. Date: Nov. 15, 2018

(65) Prior Publication Data

US 2020/0093256 A1 Mar. 26, 2020

(30) Foreign Application Priority Data

May 10, 2017 (SE) ..... 1750575-1

(51) Int. Cl.
*A47B 1/10* (2006.01)
*A47B 13/02* (2006.01)
(Continued)

(52) U.S. Cl.
CPC ..... *A47B 1/10* (2013.01); *A47B 13/023* (2013.01); *A47C 17/04* (2013.01); *B25H 1/14* (2013.01)

(58) Field of Classification Search
CPC .... B60N 2/682; B60N 2002/684; A47C 4/02; A47C 4/00; A47B 3/06; A47B 2013/022
(Continued)

(56) References Cited

U.S. PATENT DOCUMENTS 795,957 A * 8/1905 Cartland ..... A47B 88/944 312/265.1
1,355,669 A * 10/1920 Henry ..... A47C 7/26 297/440.22
(Continued)

FOREIGN PATENT DOCUMENTS

DE 3405862 A1 * 8/1985 ..... A47B 96/14
JP 55116528 U 9/1980
(Continued)

OTHER PUBLICATIONS

U.S. Pat. No. 658,852 issued Oct. 2, 1900—Kling Frank M.
International Search Report for International Application No. PCT/SE2018/050435 dated May 16, 2018 (4 pages).

*Primary Examiner* — Jose V Chen
(74) *Attorney, Agent, or Firm* — Merchant & Gould P.C.

(57) ABSTRACT

A furniture system is disclosed comprising a guiding bracket (1), a first furniture part (8) and a second furniture part (13). The first furniture part (8) is movable in view of the second furniture part (13) along a sliding direction (SD). The guiding bracket (1) comprises a through-going passage (3) forming part of a guide and having an extension coinciding with the sliding direction (SD), and an attachment protrusion (11) having an extension in a direction transverse the sliding direction (SD). The second furniture part (13) comprises a recess (12) arranged to lockingly receive the attachment protrusion (11) of the guiding bracket (1). The first furniture part (8) comprises a rail (7) arranged to extend through the through-going passage (3) of the guiding bracket (1) and to be slidable along said through-going passage (3) thereby allowing the first furniture part (8) to be movable in view of the second furniture part (13) along the sliding direction (SD). Further a guiding bracket (1) and the use of such guiding bracket in a furniture of the extendable type is disclosed.

10 Claims, 6 Drawing Sheets

(51) Int. Cl.
*A47C 17/04* (2006.01)
*B25H 1/14* (2006.01)

(58) Field of Classification Search
USPC ..... 108/180, 153.1, 158.11, 159.11, 157.16; 297/463.1, 440.1, 440.16, 440.21, 440.22, 297/440.23
See application file for complete search history.

(56) References Cited

U.S. PATENT DOCUMENTS 1,793,709 A * 2/1931 Meyers ..... F16B 12/48 108/157.16
2,605,820 A * 8/1952 Powellek ..... A47C 4/028 297/411.27
2,656,550 A * 10/1953 Loeb ..... F16B 12/60 5/295
3,451,362 A * 6/1969 Welch ..... A47B 47/042 108/60
3,589,310 A * 6/1971 Tucker ..... A47B 65/00 108/108
3,596,942 A * 8/1971 Zoebelein ..... F16B 12/22 403/230
3,835,795 A * 9/1974 Levenberg ..... A47B 17/003 108/153.1
3,989,300 A * 11/1976 Heumann ..... A47C 7/02 297/440.22
4,435,103 A * 3/1984 Becker ..... A47B 13/02 403/292
4,576,353 A * 3/1986 Valeria ..... A47C 4/03 248/165
5,080,438 A * 1/1992 Moyer ..... A47C 4/028 297/440.23
5,152,582 A * 10/1992 Magnuson ..... A47C 3/12 297/440.2
5,230,105 A * 7/1993 Watson ..... A47K 11/02 4/460
5,729,948 A * 3/1998 Levy ..... F16B 7/025 52/656.9
5,934,204 A * 8/1999 Oberle ..... A47B 13/003 108/157.1
6,047,648 A * 4/2000 Alm ..... A47B 13/021 108/157.16
6,109,819 A * 8/2000 Welch ..... A47B 13/003 248/222.41
7,300,111 B2 * 11/2007 Huang ..... A47C 4/02 297/440.14
8,978,176 B1 3/2015 Oh
2013/0134763 A1 * 5/2013 Koch ..... A47C 4/028 297/440.23
2020/0370584 A1 * 11/2020 Sjostedt ..... F16B 12/24

FOREIGN PATENT DOCUMENTS

JP 5848177 Y2 3/1983
WO WO-8701771 A1 * 3/1987 ..... A47B 47/04

* cited by examiner

FURNITURE SYSTEM

This application is a National Stage Application of PCT/SE2018/050435, filed 27 Apr. 2018, which claims benefit of Serial No. 1750575-1, filed 10 May 2017 in Sweden and which applications are incorporated herein by reference. To the extent appropriate, a claim of priority is made to each of the above disclosed applications.

TECHNICAL FIELD

The present invention refers to a furniture system.

TECHNICAL BACKGROUND

Furniture of the extendable type, such as extendable tables are well known. As a first example, typically used in wooden tables, the table comprises a frame supported by legs, a slidable table top and an extra table top. The lower side of the slidable table top is typically provided with two or more rails which are arranged to extend through a respective through opening in the frame. When sliding the table top in view of the frame, the rails are guided by the through openings, whereby a horizontally extending gap is formed into which the extra table top may be arranged. The rails and the through openings must be provided with a certain tolerance to avoid jamming problems caused by inevitable humidity changes in the ambience. Still the tolerances must not be too large since that may cause misalignment and also have a negative impact on the experienced overall quality.

Other solutions use telescoping profiles. A typical example is where the frame of the table is provided with a first longitudinally extending profile and wherein the slidable table top is provided with a second longitudinally extending profile which is arranged to be concentrically received in the first profile. As the slidable table top is pulled in view of the frame, the table top is guided by and supported by the first profile. The use of telescoping profiles is suitable for tables being composed of different materials, such as a steel/aluminum frame and a table top of wood or laminate. Although the telescoping solution at a first glance appears to be simple, it requires the telescoping profiles to be fully straight and also have smooth mating surfaces to allow a smooth sliding movement without any risk of self-locking due to misalignments or friction. Also, the overlapping length between the first and second profiles must be substantial to safeguard a stable guiding. This is specially to prevent tipping of the slidable table top when it comes close to its fully extended position. Also, the use of metal profiles adds to the weight and overall cost of the table.

In the context of the above, it must be recalled that there are also other types of extendable furnitures, such as extendable sofas, extendable pedestals and extendable desk tops. All of them face similar problems.

There is hence a need for an alternative solution to provide the extendibility of a furniture and especially an alternative solution to the type using telescoping profiles.

SUMMARY

One object of the present invention is to provide solution to the provision of an extendable furniture which allows an effective guiding without the risk of any self-locking caused by tolerance related problems.

As another object, the solution should allow a low-frictional sliding between moving parts.

As yet another object, the furniture system should be easy to assemble without the need for any specific tools.

Further, the furniture system should be cost-efficient in terms of low weight and low material consumption.

These and other objects are solved by a furniture system comprising a guiding bracket, a first furniture part and a second furniture part, wherein the first furniture part is movable in view of the second furniture part along a sliding direction, and wherein the guiding bracket comprises a through-going passage forming part of a guide and having an extension coinciding with the sliding direction, and an attachment protrusion having an extension in a direction transverse the sliding direction; the second furniture part comprises a recess arranged to lockingly receive the attachment protrusion of the guiding bracket; and the first furniture part comprises a rail arranged to extend through the through-going passage of the guiding bracket and to be slidable along said through-going passage thereby allowing the first furniture part to be movable in view of the second furniture part along the sliding direction.

Accordingly, the present furniture system provides an alternative solution to a conventional telescoping system which uses two concentric telescoping tubes, where the outer tube encloses the inner tube and wherein the guiding and stability is determined by the overlapping length. According to the present solution the outer tube is replaced by a guiding bracket having a through-going passage which encircles a rail along a strictly limited longitudinal extension of the rail. The guiding bracket provides a concentric and strictly limited overlapping length while still providing a support and guiding of the rail passing there-through. Also, since the through-going passage of the guiding bracket has a length that is substantially smaller than the overall length of the rail passing there-through, a low-frictional sliding may be provided for. Further, the risk of any tolerance related problems caused by surface irregularities on the inner or outer wall of an extruded tube are eliminated since the outer encircling tube which is an essential component of a conventional telescoping system is replaced by the guiding bracket. The guiding bracket may preferably be provided by injection molding. The guiding bracket as such may be made by a plastic material and has a substantially lower volume and weight than an outer encircling tube. Further, the overall weigh and material consumption of the furniture system may be substantially reduced since the conventional outer encircling tube is replaced by the guiding bracket.

The system may comprise at least two guiding brackets, said at least two guiding brackets being arranged at a distance from each other and with their respectively through-going passages aligned with each other. The at least two guiding brackets will together form a straight-linear guiding channel through which the rail of the first furniture part may extend concentrically. The rail will thereby receive a firm, concentric guiding by the guiding brackets while being pushed or pulled depending on if the two furniture parts should be pulled apart to provide an extension of the furniture or be pushed together.

The second furniture part may comprise a wall portion having an extension in parallel with the sliding direction, and wherein the recess is arranged in said wall portion. The second furniture part in which said recess is arranged may have a homogenous cross section and the recess may be formed as a groove or cavity formed in said wall portion. The recess may be formed as a plug or insert which is mounted to the second furniture part.

The second furniture part may comprise a longitudinal hollow profile having an extension in parallel with the sliding direction, and wherein the recess is arranged in said wall portion. The hollow profile may form part of the table frame. The longitudinal hollow profile may be e.g. an extruded, thin walled profile. The hollow profile may have a closed cross-sectional profile, such as a rectangular or quadratic. Alternatively, the hollow profile may have an open cross-sectional profile such as a U-shape or L-shape.

The recess may comprise an insertion portion and a locking portion, and the attachment protrusion of the guiding bracket may be arranged to be freely inserted into the insertion portion by a linear movement, and after insertion, the guiding bracket may be arranged to be rotated relative to the insertion portion into a locking position in which the attachment protrusion lockingly engages the locking portion. Accordingly, the combination of the recess and the attachment protrusion of the guiding bracket allows a very quick and simple mounting of the guiding bracket, without the need for any tools.

The first and second furniture parts may together form a frame of a table adapted to support a table top.

The guiding bracket may further comprise a locking pin adapted to engage a lower surface of the table top. Thereby the guiding bracket is prevented from rotation in view of the table top. This ensures that the longitudinal extension of the through-going passage remains parallel with the longitudinal extension and the sliding direction of the first furniture part.

The through-going passage may, as seen along its longitudinal extension, comprise a plurality of projections, each projection being adapted to form a sliding contact surface with the rail of the first furniture part. The plurality of projections reduces the contact area and hence friction between the rail and the inner wall of the through-going passage of the guiding bracket.

The through-going passage may have a non-rotational symmetrical cross-section. A non-rotational symmetrical cross section safe-guards a proper guiding of the first furniture in view of the second furniture part.

The first and second parts of the furniture system may be parts of a furniture of the extendable type, such as an extendable table, an extendable sofa, an extendable pedestal or an extendable workbench.

The guiding bracket to be used in an extendable furniture comprises a body having a through-going passage with a cross section adapted to slidable receive and guide a rail of a first furniture part; and an attachment protrusion adapted to lockingly engage the guiding bracket to a second furniture part. The guiding bracket as such and its advantages have been discussed above when forming part of a furniture system. To avoid undue repetition reference is made to the sections above. The guiding bracket can be provided as a unitary body by way of example injection molding which allows high volumes and a low cost per bracket. The guiding bracket may be formed by a plastic material.

The attachment protrusion may have a longitudinal extension and comprise a neck portion and a flange portion, and the width of the flange portion may exceed the width of the neck portion. The provision of a neck portion and a flange portion allows a simple mounting of the guiding bracket to a recess in a wall portion by the combination of a linear movement to insert the attachment protrusion into the recess followed by a rotational movement. The material of the wall portion encircling the edge of the recess will after rotation of the guiding bracket in view of the wall portion be received in the interspace that is formed along the neck portion between the flange portion and the body of the guiding bracket. The guiding bracket is thereby prevented from being detached from the second furniture part by a linear movement.

The guiding bracket may further comprise a locking pin, said locking pin having an extension essentially perpendicular to the longitudinal extension of the attachment protrusion. The locking pin may engage a third furniture part which is intended to interact with the guiding bracket and prevent the same from accidental linear displacement in view of the guiding bracket. An example of such third furniture part may be a table top. Further, the engagement between such third furniture part and the locking pin prevents the guiding bracket from accidentally being rotated in view of the second furniture part. This ensures that the longitudinal extension of the through-going passage remains parallel with the longitudinal extension and the sliding direction of the first furniture part. The concentric relationship between the trough-going passage of the guiding bracket and the rail is thereby safe-guarded.

The locking pin may comprise locking means adapted to lockingly engage a furniture part. The locking means may by way of example be formed as radially extending projections allowing a frictional locking engagement with a furniture part, such as the lower side of a table top.

Further objects and advantages of the present invention will be obvious to a person skilled in the art reading the detailed description given below describing different embodiments.

BRIEF DESCRIPTION OF THE DRAWINGS

The invention will be described in detail with reference to the schematic drawings.

DETAILED DESCRIPTION

Figure 1:
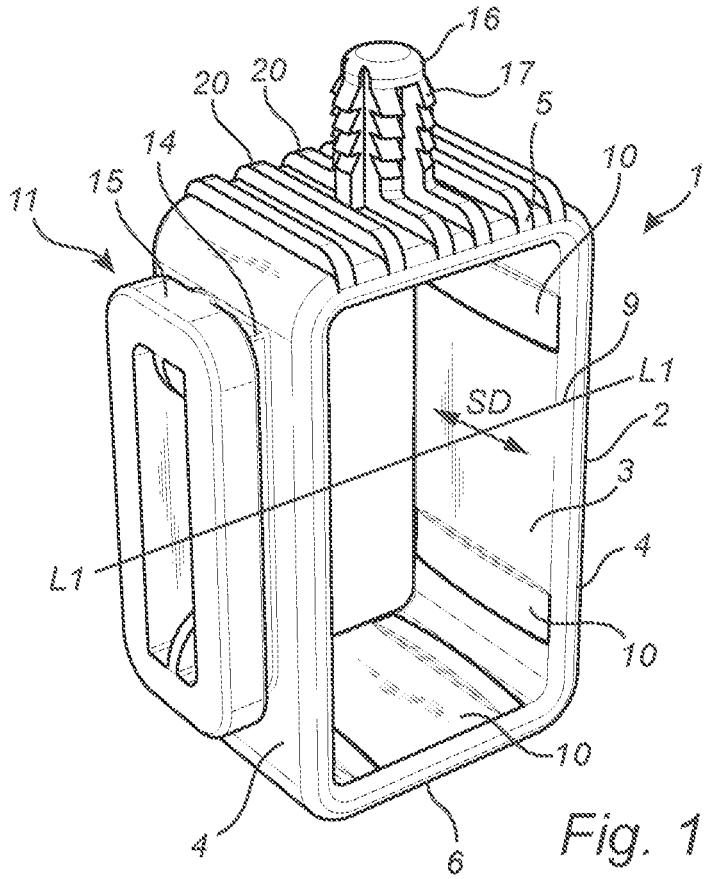
FIG. 1 discloses one embodiment of a guiding bracket.

Now turning to FIG. 1, a guiding bracket 1 to be used in a furniture system of the extendable type, such as an extendable table is disclosed. It is to be understood that the guiding bracket 1 may be used in other types of furniture of the extendable type, such as an extendable sofa, an extendable pedestal or an extendable workbench.

The guiding bracket 1 comprises a body 2 having a through-going passage 3. The through-going passage 3 is delimited by two opposing side walls 4, a top wall 5 and a bottom wall 6. The through-going passage 3 has a cross section adapted to slidable receive and concentrically guide a rail 7 of a first furniture part 8, see e.g. FIG. 4A. The through-going passage 3 has an extension coinciding with the intended sliding direction SD of the first furniture part 8.

The through-going passage 3 has an essentially rectangular, closed cross-section. Hence, the disclosed guiding bracket 1 is adapted to interact with the rail 7 of the first furniture part 8 having a corresponding, rectangular cross section. It is preferred that the through-going passage 3 has a non-rotational symmetrical cross-section whereby the rail 7 arranged to extend there-trough will receive a controlled guiding.

The inner walls 9 of the through-going passage 3 comprise as seen along its longitudinal extension, a plurality of projections 10. Each projection 10 is adapted to form a sliding contact surface with the rail 7 of the first furniture part 8. In the disclosed embodiment, the projections 10 have a longitudinal direction in parallel with the longitudinal extension of the through-going passage 3. The projections 10 have a convex single-curved longitudinal extension as seen between the opposing openings of the through-going passage 3. Thereby insertion of the rail 7 of the first furniture part 8 is facilitated. Also, a limited contact surface with the rail 7 is provided for while still providing a guiding effect. Also a low friction between the guiding bracket 1 and the rail 7 is provided for. It is to be understood that other patterns/extensions of the projections 10 may be used. By way of example the projections 10 may be dot-shaped.

The guiding bracket 1 comprises an attachment protrusion 11. The attachment protrusion 11 extends from the exterior surface of one of the two opposing side walls 4 of the guiding bracket 1 and has a longitudinal extension in a direction transverse the sliding direction SD. The attachment protrusion 11 is adapted to lockingly engage the guiding bracket 1 to a recess 12 of a second furniture part 13, see e.g. FIGS. 2 and 3A. Starting from the body 2 of the guiding bracket 1, the attachment protrusion 11 comprises a neck portion 14 and a flange portion 15. The width of the flange portion 15 exceeds the width of the neck portion 14. In the disclosed embodiment the flange portion 15 and the neck portion 14 do both have a substantially rectangular form. It is to be understood that other geometries are possible.

The neck portion 14 has a longitudinal extension preferably corresponding to the wall thickness of the second furniture part 13 to be discussed below.

The top wall 5 of the guiding bracket 1 comprises a locking pin 16. The locking pin 16 has an extension essentially perpendicular to the longitudinal extension L1 of the attachment protrusion 11. The outer wall of the locking pin 16 comprises locking means 17. The locking means 17 are provided as a plurality of projections having a radial extension. The projections may be flexible. The locking means 17 are adapted to lockingly interact with an additional furniture part 18, such as the lower surface of a table top 19 in a manner to be discussed below, see e.g. FIG. 4A.

The top wall 5 of the guiding bracket 1 comprises a plurality of shoulders 20. The design and the number of shoulders 20 may be altered. By way of example, the shoulders 20 may be replaced by the top wall 5 being provided with an increased, homogenous thickness corresponding to the height of the shoulders 20. The purpose of the shoulders 20 will be discussed below in connection to FIG. 3C.

The guiding bracket 1 is preferably made as a unitary body 2 by injection molding a plastic material.

Figure 2:
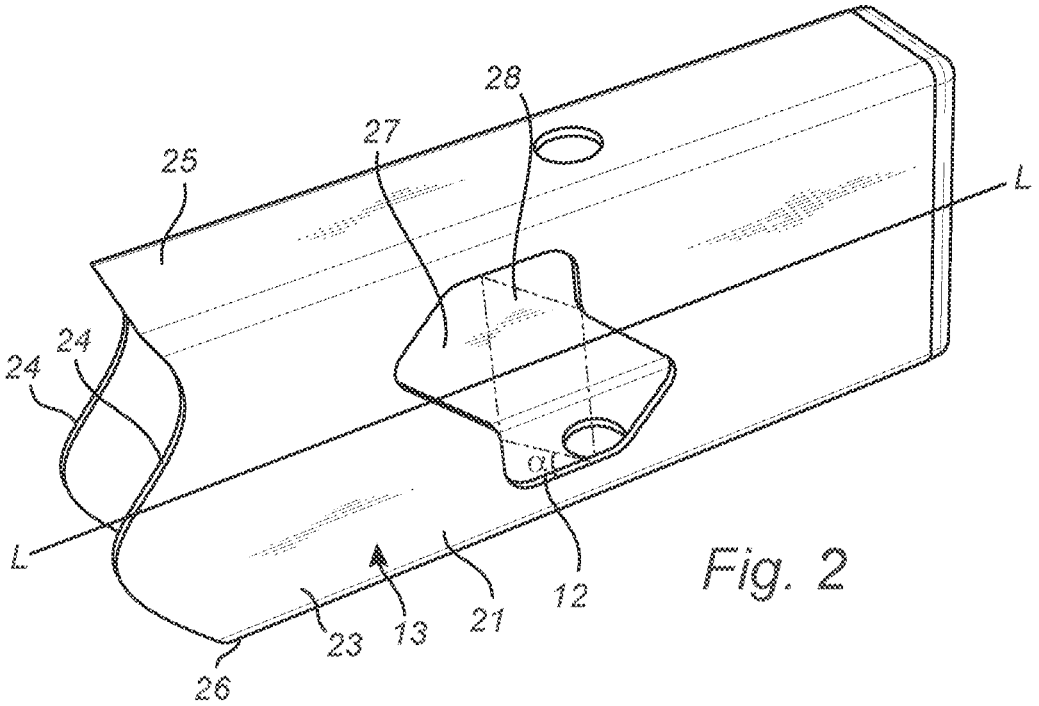
FIG. 2 discloses a portion of a second furniture part comprising a recess arranged to lockingly receive an attachment protrusion of the guiding bracket.

Now turning to FIG. 2 a portion of the second furniture part 13 is disclosed. The second furniture part 13 may be a frame 21 or a part of a frame 21, such as the frame 21 of a table which is intended to support a table top 19 and legs 22 of the table. In the disclosed embodiment, the second furniture part 13 comprises a profile 23 having a hollow cross section. In the disclosed embodiment the second furniture part 13 has a rectangular hollow cross section with two opposing side walls 24, a top wall 25 and a bottom wall 26. When used in a table, the top wall 25 is adapted to face the table top 19. The second furniture part 13 may by way of example be an extruded metal profile 23.

One of the two opposing side walls 24 of the second furniture part 13 is provided with a recess 12. The thickness of the side wall 24 provided with the recess 12 is slightly smaller than the longitudinal extension L1 of the neck portion 14 of the guiding bracket 1.

The boundary of the recess 12 is virtually divided into an insertion portion 27 and a locking portion 28. The insertion portion 27 has a profile allowing insertion of the attachment protrusion 11 of the guiding bracket 1 by means of a linear movement. Thus, the insertion portion 27 preferably has a virtual cross-sectional profile corresponding to the cross sectional profile of the flange portion 15 of the attachment protrusion 11. The insertion portion 27 has a geometrical longitudinal axis which forms an angle $\alpha$ of 20-90 degrees and more preferred 30-50 degrees to the longitudinal extension L of the second furniture part 13.

The locking portion 28 preferably has a cross-sectional profile corresponding to the neck portion 14 of the guiding bracket 1. The locking portion 28 has a geometrical longitudinal extension being essentially perpendicular to the longitudinal extension L of the second furniture part 23.

Figure 3A:
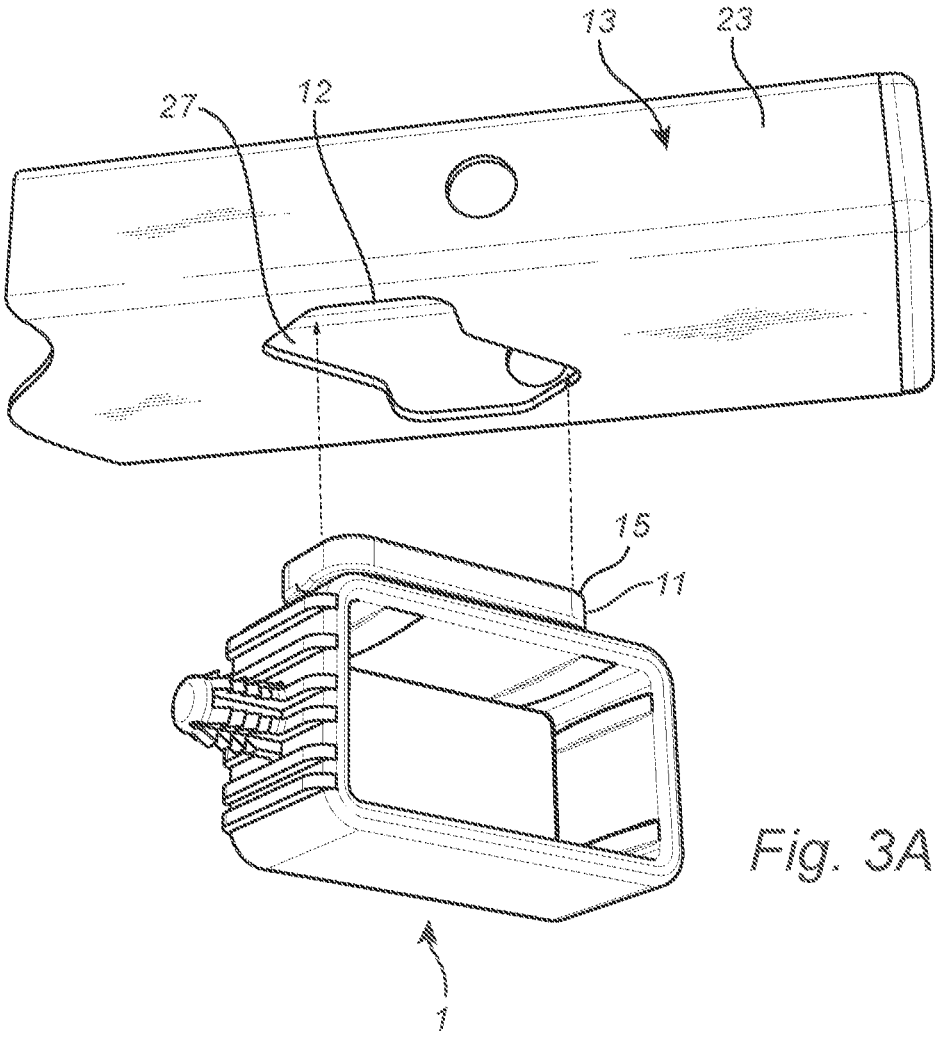
FIGS. 3A-3C discloses the locking interaction between the guiding bracket and the second furniture part.
Figure 3B:
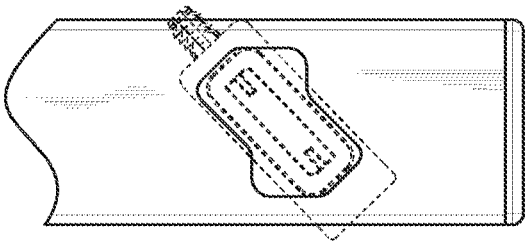
Figure 3B:
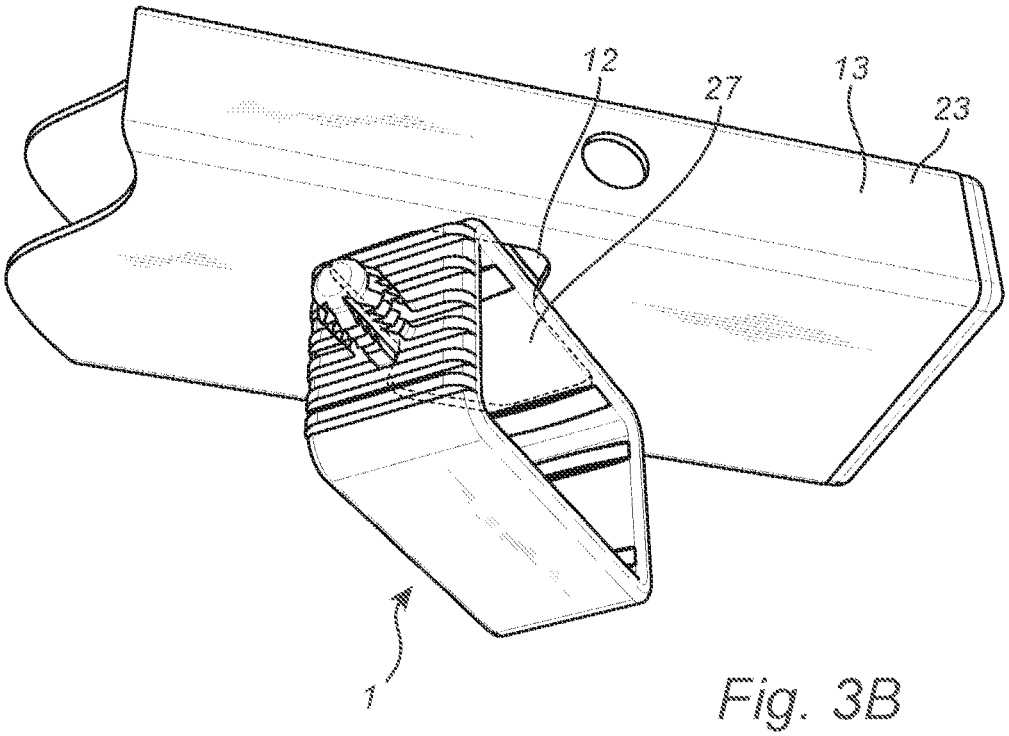

Now turning to FIGS. 3A-3C, the locking engagement between the guiding bracket 1 and the second furniture part 13 will be discussed.

When mounting the guiding bracket 1 to the second furniture part 13, the operator inserts the attachment protrusion 11 of the guiding bracket 1 into the recess 12 of the second furniture part 13 by inserting the attachment protrusion 11 through the insertion portion 27 by a linear movement. A free linear movement is allowed by the insertion portion 27 having a cross-section corresponding to the flange portion 15 of the attachment protrusion 11, see FIGS. 3A-3B. Now turning to FIG. 3C, the operator then rotates the guiding bracket 1 relative to the insertion portion 27 towards a locking position. When rotated to the locking position, the longitudinal extension of the through-going passage 3 of the guiding bracket 1 becomes parallel with the longitudinal extension L of the second furniture part 13.

When rotated to the locking position, the attachment protrusion 11 lockingly engages the locking portion 28. The locking is provided by the flange portion 15 of the attachment protrusion 11 engaging the inner surface of the side wall 25 of the profile 23 of the second furniture part 13. The guiding bracket 1 is thereby prevented from being linearly pulled in a direction transverse the longitudinal extension L of the second furniture part 13. Also, when rotated to the locking position, a portion of the side wall 25 of the profile 23 of the second furniture part 13 is received in the interspace which is formed by the flange portion 15, the neck portion 14 and the body 2 of the guiding bracket 1. By providing the neck portion 14 with a length corresponding to the thickness of the side wall 25 of the profile 23, a frictional engagement may be provided, which adds to the locking effect.

Figure 3C:
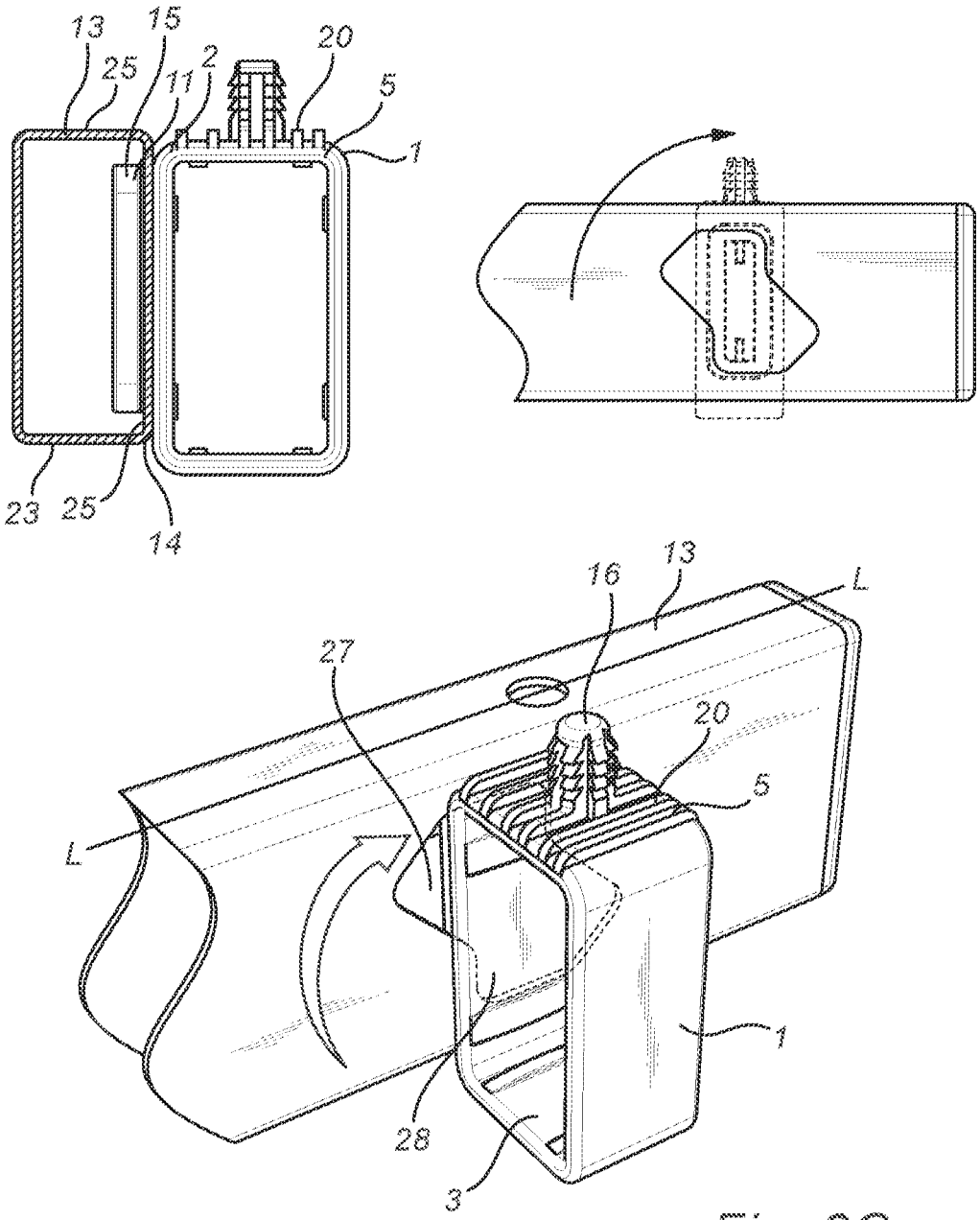
Figure 4A:
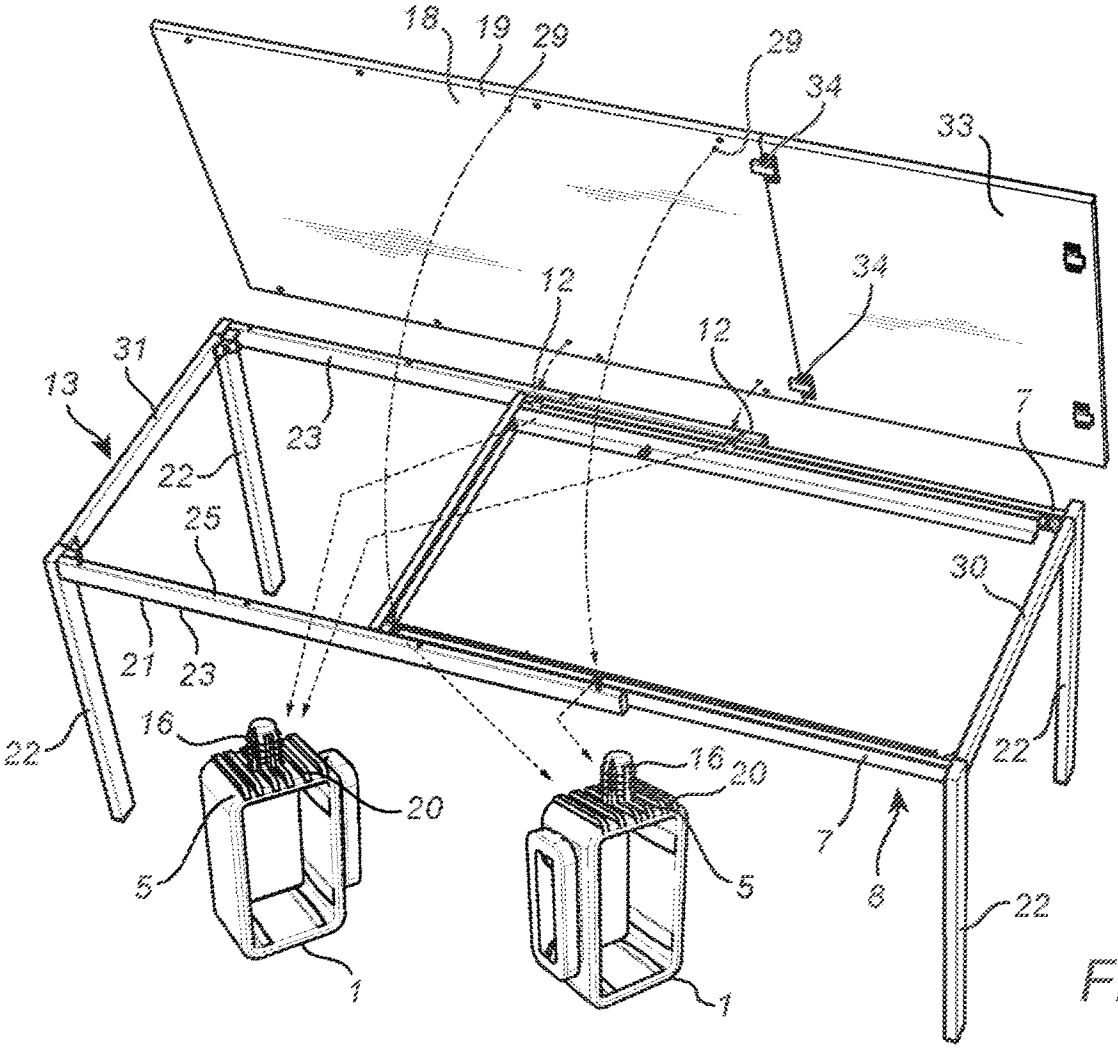
FIGS. 4A and 4B discloses a furniture system in the form of an extendable table using the guiding bracket.

As is best seen in FIG. 3C, the locking pin 16 is arranged to extend perpendicular to the longitudinal extension L of the second furniture part 13 when the guiding bracket 1 is set to the locking position. Also, the shoulders 20 of the top wall 5 of the guiding bracket 1 are in flush with the top wall 25 of the profile 23 of the second furniture part 13. When mounting a table top 19 onto the second furniture part 13, the locking pin 16 will engage a mating hole 29 in the lower surface of the table top 19. This is best seen in FIG. 4A. Also, the table top 19 will be supported by the top wall 25 of the second furniture part 13 and also by the shoulders 20 of the guiding bracket 1.

Now turning to FIGS. 4A and 4B the operation of the guiding bracket 1 will be discussed as applied to a table of the extendable type.

The table comprises a rectangular frame 21 comprising a first furniture part 8 and a second furniture part 13, wherein the first furniture part 8 is movable by sliding in view of the second furniture part 13.

The first furniture part 8 comprises two table legs 22, a cross bar 30 and two rails 7 projecting from the cross bar 30. The two rails 7 may have a homogenous cross section or a hollow cross section. In case of a hollow cross section, the cross section may be a closed profile such as a rectangular or quadrangular cross section or an open profile such as a U-shape or L-shape. The cross-section is preferably non-rotational symmetric.

The second furniture part 13 comprises two table legs 22, a cross bar 31 and two profiles 23 projecting from the cross bar 31. The two profiles 23 may have a homogenous cross section or a hollow cross section. In case of a hollow cross section, the cross section may be a closed profile such as a rectangular or quadrangular cross section or an open profile such as a U-shape or an L-shape. The cross-section is preferably non-rotational symmetric. In case of an open profile, a wall of such profile 23 should be arranged to face the rails 7 of the first furniture part 8.

Each of the two profiles 23 of the second furniture part 13 comprises a recess 12 of the type discussed above. The recess 12 is arranged in the side wall 24 of the profile 23 which faces the two rails 7 of the first furniture part 8. It is preferred that the respective profiles 23 of the second furniture part 13 comprise at least two recesses 12.

The at least two recesses 12 are arranged on a distance from each other and aligned along the longitudinal extension of the two profiles 23. Thus, when the guiding bracket 1 are lockingly arranged to the recesses 12, the through-going passages 3 of the guiding brackets 1 together form a linear intermittent passage allowing insertion and concentric guiding of the rails 7 of the first furniture part 8. Thus, when the rails 7 of the first furniture part 8 are inserted into the through-going passages 3, the first furniture part 8 is movable by a sliding action in view of the second furniture part 13 while being guided by the guiding brackets 1. The at least two guiding brackets 1 together with the rail 7 extending through the through-going passage 3 of the respective guiding brackets 1 can be seen as a type of telescoping arrangement.

The table top 19 is supported by the second furniture part 13. The table top 19 is secured to the second furniture parts 13. The securing can by way of example be made by screws (not shown). The screws may be arranged to extend through the profiles 23 of the second furniture part 13. Further, when the table top 19 is supported by the second furniture part 13, the locking pins 16 of the respective guiding brackets 1 engage corresponding holes 29 in the lower surface of the table top 16, thereby preventing the guiding brackets 1 from rotation.

Figure 4B:
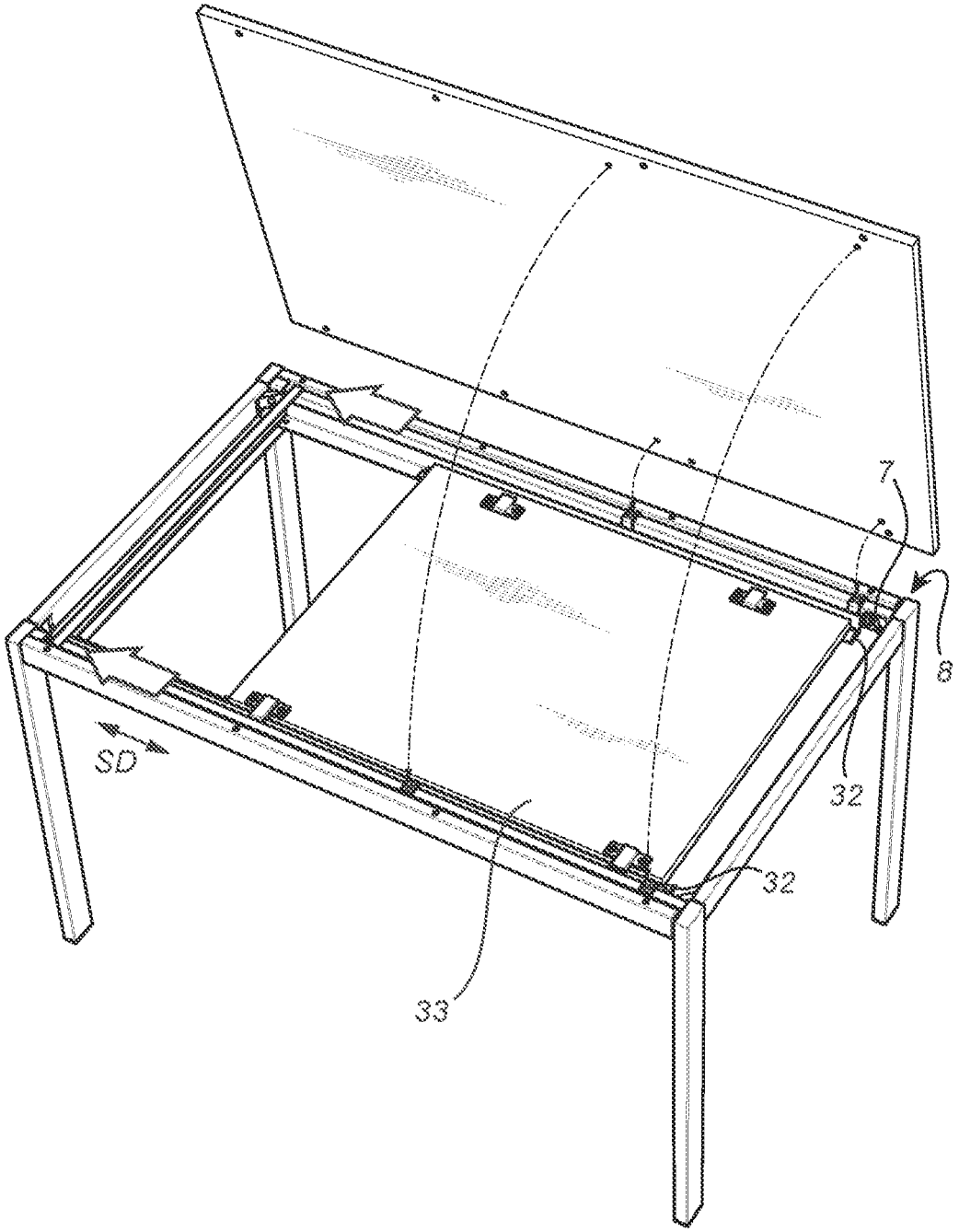

As is best seen in FIG. 4B, the rails 7 of the first furniture part 8 may be provided with brackets 32. The brackets 32 form a console for an extra table-top 33 to be stored thereon when not in use. When the first and second furniture parts 8, 13 are pulled apart to the extended position disclosed in FIG. 4A, the extra table top 33 can be attached either to the ordinary table top 19 by brackets 34 as disclosed in FIG. 4A or simply be loosely arranged next to the ordinary table top 19 while being supported by the rails 7 of the first furniture part 8.

The invention has been described as relating to a table of the extendable type. It is to be understood that the same principle is equally applicable to other types of furniture of the extendable type. As non-restricting examples, the furniture may be an extendable sofa, an extendable pedestal or an extendable workbench.

The rails 7 and the mating through-going passage 3 of the guiding bracket 1 have been disclosed and exemplified as rectangular hollow profiles. It is to be understood that other profiles are possible with remained function. It is however preferred that the profile chosen has a non-rotational cross-sectional to facilitate guiding.

The rails may be formed by a metallic material, a plastic material, a composite material or even wood.

The attachment protrusion 11 and the corresponding mating profile of the virtual insertion and locking portions 27, 28 of the recess 12 of the second furniture part 13 may be provided with other profiles with remained function. Thus, the invention should not be restricted to the essentially rectangular shape of the flange and neck of the attachment protrusion 11.

The free end of the respective rail 7 of the first furniture part 8 may be provided with stop members (not disclosed) adapted to engage the guiding bracket 1 to thereby prevent an accidental separation of the first and second furniture parts if they should be pulled apart too long.

The profile 23 of the second furniture part 13 may be provided with a homogenous cross section. The recess 12 to be formed therein may be provided as a milled groove. Alternatively, the recess 12 may be provided by an insert or plug to be fixed to the side wall of the profile 23. The insert or plug may by way of example be arranged in a recess formed in the profile 23. The invention should hence not be restricted to the recess 12 being formed as a through-going hole in a hollow profile 23.

The invention claimed is:

1. Furniture system comprising a guiding bracket, a first furniture part, and a second furniture part, wherein the first furniture part is movable in view of the second furniture part along a sliding direction (SD), and wherein:

the guiding bracket comprises a through-going passage forming part of a guide and having an extension coinciding with the sliding direction (SD), and an attachment protrusion having an extension in a direction transverse the sliding direction (SD);

the second furniture part comprises a recess arranged to lockingly receive the attachment protrusion of the guiding bracket; and the first furniture part comprises a rail arranged to extend through the through-going passage of the guiding bracket and to be slidable along said through-going passage thereby allowing the first furniture part to be movable in view of the second furniture part along the sliding direction (SD).

2. Furniture system according to claim 1, wherein the furniture system comprises at least two guiding brackets, said at least two guiding brackets being arranged at a distance from each other and with their respectively through-going passages aligned with each other.

3. Furniture system according to claim 1, wherein the second furniture part comprises a side wall portion having an extension in parallel with the sliding direction (SD), and wherein the recess is arranged in said wall portion.

4. Furniture system according to claim 3, wherein the second furniture part-comprises a longitudinal hollow profile having a longitudinal extension (L) in parallel with the sliding direction (SD), and wherein the recess is arranged in said wall portion.

5. Furniture system according to claim 1, wherein the recess comprises an insertion portion and a locking portion, and wherein the attachment protrusion of the guiding bracket is arranged to be freely inserted into the insertion portion by a linear movement, and wherein the guiding bracket, after insertion, is arranged to be rotated relative to the insertion portion into a locking position in which the attachment protrusion lockingly engages the locking portion.

6. Furniture system according to claim 1, wherein the first and second furniture parts together form a frame of a table adapted to support a table top.

7. Furniture system according to claim 6, wherein the guiding bracket further comprises a locking pin adapted to engage a lower surface of the table top.

8. Furniture system according to claim 1, wherein the through-going passage comprises a plurality of projections, each projection being adapted to form a sliding contact surface with the rail of the first furniture part.

9. Furniture system according to claim 1, wherein the through-going passage has a non-rotational symmetrical cross-section.

10. Furniture system according to claim 1, where the first furniture part and the second furniture part are parts of a furniture of the extendable type, such as an extendable table, a sofa, a pedestal or a workbench.

* * * * *